US005316721A

United States Patent [19]

Sugitani et al.

[11] Patent Number: 5,316,721

[45] Date of Patent: May 31, 1994

[54] HEAT-RESISTANT ALLOY HAVING HIGH CREEP RUPTURE STRENGTH UNDER HIGH-TEMPERATURE LOW-STRESS CONDITIONS AND EXCELLENT RESISTANCE TO CARBURIZATION

[75] Inventors: Junichi Sugitani; Masahiro Inui; Koji Tsuchida, all of Hirakata; Teruo Yoshimoto, Suita, all of Japan

[73] Assignee: Kubota Corporation, Osaka, Japan

[21] Appl. No.: 814,154

[22] Filed: Dec. 30, 1991

[51] Int. Cl.[5] ..... C22C 38/34; C22C 30/00

[52] U.S. Cl. ..... 420/50; 420/51; 420/584.1

[58] Field of Search ..... 420/50, 51, 584; 148/909

[56] References Cited

U.S. PATENT DOCUMENTS 5,021,215 6/1991 Sawaragi et al. ..... 420/584.1

*Primary Examiner*—Deborah Yee

*Attorney, Agent, or Firm*—Armstrong, Westerman, Hattori, McLeland & Naughton

[57] ABSTRACT

A heat-resistant alloy having a high creep rupture strength under high-temperature low-stress conditions and excellent resistance to carburization even when used at a high temperature exceeding 1100° C. The alloy comprises, in % by weight, more than 0.1% to less than 1.5% of C, more than 2% to less than 3% of Si, more than 0% to less than 2% of Mn, more than 20% to less than 30% of Cr, more than 25% to less than 40% of Ni, more than 0.6% to less than 2% of Al, and the balance Fe and inevitable impurities. When required, the alloy contains at least one component selected from the group consisting of 0.01 to 0.5% of Zr, up to 0.2% of N, 0.2 to 2.0% of Nb, 0.2 to 2.0% of W and 0.01 to 03% of Ti.

4 Claims, 2 Drawing Sheets

HEAT-RESISTANT ALLOY HAVING HIGH CREEP RUPTURE STRENGTH UNDER HIGH-TEMPERATURE LOW-STRESS CONDITIONS AND EXCELLENT RESISTANCE TO CARBURIZATION

FIELD OF INDUSTRIAL APPLICATION

The present invention relates to improvements in heat-resistant alloys which are useful as materials for thermal cracking or reforming reactor tubes for hydrocarbons, such as ethylene production cracking tubes and reformer tubes. More particularly, the invention relates to heat-resistant alloys having a high creep rupture strength under high-temperature low-stress conditions and high resistance to carburization.

BACKGROUND OF THE INVENTION

Ethylene is produced by charging naphtha, ethane, butane or like starting material and steam into a cracking tube and heating the tube from outside to a high temperature in excess of 1000° C. to crack the material within the tube with radiant heat. The material to be used for the tube must therefore be excellent in strength (especially in creep rupture strength) at high temperatures and in oxidation resistance.

The process for cracking naphtha or like material produces free carbon, which becomes deposited on the inner surface of the tube and reacts with the tube material to cause carburization and embrittle the material. Accordingly the tube material needs to have high resistance to carburization.

The cracking tube is generally fabricated in the form of a coil which comprises straight tube portions as joined to one another and to bends. Since tube components are joined together by TIG welding, MIG welding or shielded metal arc welding, excellent weldability is also required of the material.

HP improved material according to ASTM standards (0.45C-25Cr-35Ni-Nb,W,Mo-Fe) has been in wide use, for example, for making cracking tubes for producing ethylene. However, with a rise in the operating temperature in recent years, this material encounters the problem of becoming seriously impaired in oxidation resistance, creep rupture strength and carburization resistance if used at a temperature exceeding 1100° C.

Accordingly, for use in operation at high temperatures of above 1100° C., an alloy has been developed which comprises 0.3 to 0.8% C, 0.5 to 3% Si, up to 2% Mn, 23 to 30% Cr, 40 to 55% Ni, 0.2 to 1.8% Nb, 0.08 to 0.2% N, 0.01 to 0.5% Ti and/or 0.01 to 0.5% Zr, and the balance substantially Fe (U.S. Pat. No. 5,019,331).

This alloy is characterized in that the Cr content is held in proper balance with the content(s) of Ti and/or Zr, and that Nb, N, etc. are caused to form suitable amounts of carbonitrides to give the desired high-temperature strength.

However, we have found that the presence of at least 40% of Ni renders the alloy subsceptible to weld cracking to entail an increased likelihood of weld cracking. Nevertheless, a reduction in the Ni content results in lower carburization resistance because the oxide film formed in the vicinity of the surface of the tube and contributing to the prevention of carburization then becomes unstable, leading to lower carburization resistance. Furthermore, the reduced Ni content results in the drawback of lower strength at high temperatures.

On the other hand, investigations of creep rupture strength characteristics required of cracking tubes have revealed the following. Although the tube is actually used under high-temperature low-stress conditions (about 1100° C.×0.2–0.3 kg/mm$^2$). the creep rupture strength has heretofore been estimated in view of the creep rupture time determined under low-temperature high-stress conditions. Thus, if a material has low creep rupture strength under low-temperature high-stress conditions, no further creep rupture test for said material was conducted as a rule under high-temperature low-stress conditions because the testing time becomes extremely longer under the high-temperature low-stress conditions, and further because it has been thought that the creep rupture strength, if high under low-temperature high-stress conditions, is correspondingly high also under high-temperature low-stress conditions.

We have found that the strength under high-stress conditions is not always in proportional relation with the strength under low-stress conditions. Thus, tubes having a high rupture strength under high-stress conditions do not always have a high rupture strength similarly under low-stress conditions.

We have further examined the relationship between the stress condition and the creep rupture time and found that the creep rupture strength characteristics are in opposite relation below and above the stress condition of about 1.0 to about 1.2 kg/mm$^2$ when Si, Ni and Al are in a specified relation. Our research has also revealed that when having a high creep rupture strength under the condition of 1093° C., 0.9 kg/mm$^2$, cracking tubes exhibit a similarly high creep rupture strength under the actual conditions for use.

Based on the above findings, we have developed an alloy having a high creep rupture strength under high-temperature low-stress conditions and excellent resistance to carburization although reduced in Ni content.

SUMMARY OF THE INVENTION

An object of the present invention is to provide a heat-resistant alloy which is most distinctly characterized by a synergistic effect of Si and Al and which has a high creep rupture strength and excellent carburization resistance even when used at a high temperature exceeding 1100° C.

The heat-resistant alloy of the present invention comprises, in % by weight, more than 0.1 % to less than 1.5% of C, more than 2% to less than 3% of Si, more than 0% to less than 2% of Mn, more than 20% to less than 30% of Cr, more than 25% to less than 40% of Ni, more than 0.6% to less than 2% of Al, and the balance Fe and inevitable impurities.

When required, the heat-resistant alloy of the invention has further incorporated therein at least one component selected from the group consisting of 0.01 to 0.5% of Zr, up to 0.2% of N, 0.2 to 2.0% of Nb, 0.2 to 2.0% of W and 0.01 to 0.3% of Ti. The additional component gives the alloy a further improved creep rupture strength under high-temperature low-stress conditions.

DETAILED DESCRIPTION OF THE INVENTION

Figure 1:
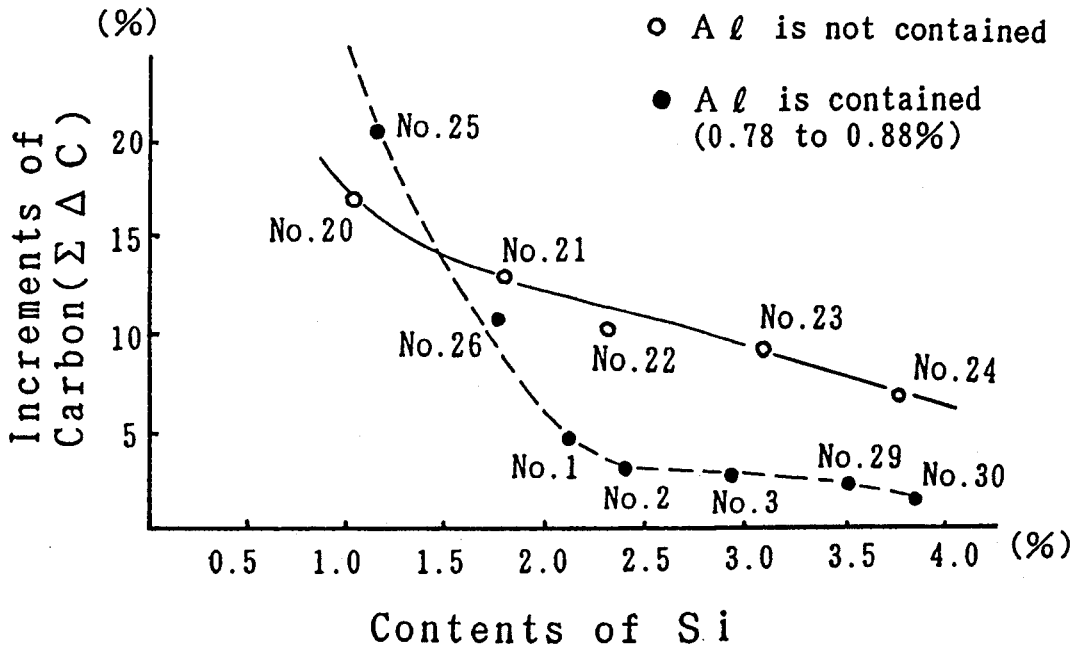
FIG. 1 is a graph showing the relationship of the increase in the amount of C to the Al and Si contents.

The heat-resistant alloy of the present invention has the foregoing composition wherein the contents of components are limited as stated for the following reasons.

C: more than 0.1% to less than 1.5%

C forms Cr and like carbides at the grain boundary when the alloy solidifies on casting. C also forms a solid solution in an austenitic phase, further forming Cr carbide in the austenitic phase after the alloy is heated again. The carbides thus formed afford an improved creep rupture strength. The higher the C content, the more improved is the castability of the alloy. However, presence of an excess of C embrittles the material, which is therefore prone to cracking upon casting or welding. Accordingly, the C content should be more than 0.1% to less than 1.5%.

Si: more than 2% to less than 3%

While Si is effective for deoxidation in preparing the alloy by melting and gives improved flowability to the molten alloy, the contribution of Si to carburization resistance is important according to the present invention. Si is effective for giving improved carburization resistance to cracking tubes by forming an $SiO_2$ film in the vicinity of the tube surface and thereby inhibiting penetration of C.

To ensure satisfactory carburization resistance at temperatures of not lower than 1100° C., we have made intensive research on the relationship between Si and Al to be described later and found that a film of Si-Al double oxide, when formed, imparts remarkably improved carburization resistance.

Nevertheless, little or no Si-Al double oxide is formed if the Si content is up to 2%, so that more than 2% Si needs to be present. Although it has been reported that Si contents exceeding 2% result in a reduced creep breakdown strength, we have found that presence of a specified amount of Al ensures an excellent creep rupture strength under low-stress conditions.

On the other hand, the material seriously deteriorates, exhibiting a lower creep strength and impaired weldability when containing not less than 3% of Si. The Si content should therefore be more than 2% to less than 3%, preferably 2.2 to 2.8%.

Mn: more than 0% to less than 2%

Like Si, Mn acts as a deoxidizer and fixes S (sulfur) during preparation of the alloy in a molten state to give improved weldability. However, presence of not less than 2% of Mn fails to achieve a corresponding effect, so that the upper limit of the Mn content is less than 2%.

Cr: more than 20% to less than 30%

Cr is an element which is indispensable in maintaining oxidation resistance and high-temperature strength. Nevertheless, presence of an excess of Cr makes the alloy susceptible to cracking during casting or solidification, while excessive precipitation of the carbide due to use at a high temperature entails lower ductility. The Cr content is therefore more than 20% to less than 30%.

Ni: more than 25% to less than 40%

Ni forms an austenitic phase along with Cr and Fe, contributing to improvements in high-temperature strength and oxidation resistance. Further when used for making cracking tubes, Ni stabilizes the oxide film in the vicinity of the tube surface, thus contributing to an improvement in carburization resistance. If the Ni content is up to 25%, these effects are not expectable greatly. Since these effects become enhanced with increasing Ni content, it is desirable to make the Ni content as high as possible for use in a temperature range of not lower than 1100° C. However, presence of not less than 40% of Ni renders the alloy more susceptible to cracking during welding, and the alloy is liable to crack on wlding as previously stated. Accordingly, the Ni content should be more than 25% to less than 40%.

Al: more than 0.6% to less than 2%

Al is effective for improvements in oxidation resistance and creep rupture strength at high temperatures. Further when the alloy is used for preparing cracking tubes, Al forms an $Al_2O_3$ film on the tube surface, impeding penetration of C and affording improved resistance to carburization. Especially when more than 2% of Si is present, an Si-Al double oxide film is formed to result in remarkably increased resistance to carburization.

The alloy of the present invention is intended for use at high temperatures of not lower than 1100° C., whereas the low Ni content, which is less than 40% as described above, makes it necessary to compensate for deficiencies in carburization resistance and high-temperature strength by a synergistic effect of Al and Si. However, if the content is up to 0.6%, the desired effect is not available in the two characteristics of creep rupture strength and carburization resistance. For this reason, the lower limit of the Al content is more than 0.6%.

Incidentally, the effect to achieve improvements in creep rupture strength and carburization resistance increases with increasing Al content. Nevertheless, presence of not less than 2% of Al not only makes the alloy prone to cracking during solidification subsequent to casting and during welding but also entails seriously ruduced ductility during use at high temperatures. Accordingly, presene of not less than 2% of Al should be avoided. Thus, the upper limit is less than 2%.

Reportedly, Al contents in excess of 0.6% not only fail to achieve improved creep rupture strength but also undesirably result in impaired ductility, and are therefore undesirable (Examined Japanese Patent Publication SHO 63-4897). However, intensive research we have conducted has revealed that presence of more than 0.6% of Al achieves no improvement in creep rupture strength under high-stress conditions but results in an improved creep rupture strength under low-stress conditions which are below about 1.0 to about 1.2 $kg/mm^2$ in stress. Presumably, the improvement is attributable to the precipitation of Ni-Al intermetallic compound (such as $Ni_3Al$) The stress acting on cracking tubes during operation is about 0.2 to about 0.3 $kg/mm^2$ as previously described, so that only the creep rupture strength under low-stress conditions matters. Further although presence of Al inevitably leads to lower ductility, the tube is actually usable free of trouble if the Al content is less than about 2%. Accordingly, the Al content should be more than 0.6% to less than 2%, preferably 0.7% to 1.8%.

The heat resistant alloy of the present invention comprises the above component elements, the balance being impurity elements which become inevitably incorporated and Fe.

When required, the heat-resistant alloy of the invention can be made to contain at least one of the following component elements. While these elements afford an improved creep rupture strength, they are significant in being very effective for adding to strength especially under low-stress conditions.

Zr: 0.01-0.5%

Although a eutectic carbide is produced during solidification of the alloy, addition of Zr breaks and disperses the carbide, consequently preventing cracks from developing along the carbide during creep to give an improved creep rupture strength. The element further inhibits chromium carbide of the $M_{23}C_6$ type from precipitating and forming coarse particles during use and is therefore effective in retarding progress of creep. On the other hand, if the alloy has an excessive Zr content, a large amount of Zr carbide will precipitate to impair the ductility of the material. Accordingly, the preferred Zr content is in the range of 0.01 to 0.5%.

N: up to 0.2%

In the form of a solid solution, nitrogen stabilizes and reinforces the austenitic phase, and participates in the formation of nitrides and carbonitride to contribute to an improvement in creep rupture strength. However, presence of an excess of N results in higher hardness and impaired tensile elongation at room temperature, so that the upper limit is preferably 0.2%.

Nb: 0.2-2.0%

Nb forms Nb carbide and Nb carbonitride at the grain boundary during solidification of the alloy as cast. Presence of these compounds gives enhanced resistance to intergranular fracture and increased creep rupture strength. For this purpose, it is desired that at least 0.2% of Nb be present. However, the Nb content, if exceeding 2.0%, leads to lower oxidation resistance, hence the upper limit of 2.0%.

W: 0.2-2.0%

W forms a solid solution with the austenitic phase and a carbide at the grain boundary, thereby giving an improved creep rupture strength. Accordingly, it is desired that at least 0.2% of W be present. Nevertheless, presence of an excess of W entails higher hardness, lower ductility and impaired workability or weldability. The upper limit is therefore 2.0%.

Ti: 0.01-0.3%

When the alloy is used for cracking tubes, Ti retards growth of coarser particles of Cr carbide which is formed in the austenitic phase by reheating, contributing an improvement in creep rupture strength. For this purpose, it is desired that at least 0.01% of Ti be present, whereas presence of more than 0.3% of Ti produces no corresponding effect. The upper limit is therefore 0.3%.

The outstanding characteristics of the alloy of the invention will be described in detail with reference to the following examples.

EXAMPLES

Alloys of different compositions were prepared by a high-frequency induction melting furnace and centrifugally cast into small sample tubes, 130 mm in outside diameter, 90 mm in inside diameter and 500 mm in length. The chemical compositions of the sample tubes are shown in Table 1, in which samples No. 1 to No. 14 are examples of the invention, and samples No. 20 to 32 are comparative examples.

Test pieces, 12 mm in diameter and 60 mm in length were prepared from the respective sample tubes and subjected to a solid carburization test.

For the solid carburization test, each sample tube was filled with a solid carburizing agent (Durferrit KG 30 containing $BaCO_3$), maintained at a temperature of 1150° C. for 500 hours and thereafter checked for the amount of carburization. The amount of carburization was measured by collecting from the test piece a layer having a depth of 4 mm from its surface and obtained in the form of particulate chips at an interval of 0.5 mm, determining the amounts of C in the collected chip portions and calculating the sum of increments in the amount of C (wt. %) of all the portions. Table 2 shows the result.

Further samples Nos. 1-14, No. 2, No. 22 and Nos. 29-32 were tested for creep rupture under the condition of 1093° C., 0.9 kg/mm$^2$. Incidentally, samples No. 2 and No. 21 were tested for creep rupture under varying conditions to measure the rupture time.

TABLE 1

| | Chemical Composition (wt %) (Balance: substantially Fe) | | | | | | | | | | | |
|---|---|---|---|---|---|---|---|---|---|---|---|---|
| No. | C | Si | Mn | Cr | Ni | Al | Zr | Nb | Ti | W | N | Mo |
| 1 | 0.44 | 2.12 | 0.93 | 25.38 | 35.16 | 0.83 | — | — | — | — | — | — |
| 2 | 0.46 | 2.40 | 0.88 | 24.87 | 34.99 | 0.78 | — | — | — | — | — | — |
| 3 | 0.47 | 2.95 | 1.03 | 25.65 | 35.05 | 0.82 | — | — | — | — | — | — |
| 4 | 0.45 | 2.33 | 1.05 | 25.01 | 35.65 | 1.65 | — | — | — | — | — | — |
| 5 | 0.45 | 2.25 | 0.95 | 25.05 | 36.06 | 1.90 | — | — | — | — | — | — |
| 6 | 0.45 | 2.25 | 0.86 | 24.75 | 35.05 | 0.85 | 0.15 | — | — | — | — | — |
| 7 | 0.45 | 2.31 | 0.94 | 24.98 | 35.17 | 0.85 | — | 0.65 | — | — | — | — |
| 8 | 0.46 | 2.28 | 0.89 | 25.11 | 34.96 | 0.78 | — | 0.72 | 0.10 | — | — | — |
| 9 | 0.45 | 2.17 | 0.90 | 24.97 | 35.02 | 0.95 | — | 0.45 | — | 0.56 | — | — |
| 10 | 0.44 | 2.43 | 0.89 | 24.65 | 36.21 | 0.75 | — | — | 0.25 | — | — | — |
| 11 | 0.44 | 2.26 | 0.98 | 24.45 | 36.25 | 0.78 | — | — | — | 0.42 | — | — |
| 12 | 0.49 | 2.20 | 0.95 | 24.61 | 37.03 | 0.72 | 0.13 | 0.44 | 0.12 | — | — | — |
| 13 | 0.47 | 2.24 | 0.97 | 24.50 | 37.15 | 0.79 | 0.11 | 0.43 | 0.08 | 0.45 | — | — |
| 14 | 0.46 | 2.34 | 0.98 | 24.96 | 35.02 | 0.88 | — | — | — | — | 0.08 | — |
| 20 | 0.45 | 1.04 | 0.98 | 25.03 | 35.06 | — | — | — | — | — | — | — |
| 21 | 0.47 | 1.78 | 0.87 | 25.63 | 34.97 | — | — | — | — | — | — | — |
| 22 | 0.46 | 2.30 | 1.01 | 25.22 | 34.85 | — | — | — | — | — | — | — |
| 23 | 0.45 | 3.08 | 0.95 | 25.35 | 35.71 | — | — | — | — | — | — | — |
| 24 | 0.45 | 3.77 | 0.93 | 24.98 | 35.02 | — | — | — | — | — | — | — |
| 25 | 0.43 | 1.16 | 0.89 | 25.16 | 34.84 | 0.86 | — | — | — | — | — | — |
| 26 | 0.45 | 1.76 | 0.91 | 25.28 | 35.63 | 0.80 | — | — | — | — | — | — |
| 27 | 0.44 | 1.57 | 0.97 | 26.05 | 35.32 | 1.77 | — | — | — | — | — | — |
| 28 | 0.45 | 1.52 | 0.98 | 25.27 | 35.46 | 2.67 | — | — | — | — | — | — |
| 29 | 0.43 | 3.53 | 1.02 | 25.06 | 35.43 | 0.88 | — | — | — | — | — | — |
| 30 | 0.45 | 3.86 | 0.96 | 24.83 | 36.02 | 0.85 | — | — | — | — | — | — |
| 31 | 0.47 | 1.78 | 0.48 | 25.51 | 35.64 | — | — | 1.27 | — | 0.73 | — | 0.46 |
| 32 | 0.46 | 2.31 | 0.95 | 24.99 | 35.03 | 0.48 | — | — | — | — | — | — |

TABLE 2

| No. | Increment of Carbon (wt %) ΣΔC | Creep Rupture Time (hours) 871° C. × 4.0 kg/mm² | 982° C. × 2.5 kg/mm² | 1038° C. × 1.8 kg/mm² | 1038° C. × 1.3 kg/mm² | 1093° C. × 0.9 kg/mm² | 1093° C. × 0.7 kg/mm² |
|---|---|---|---|---|---|---|---|
| 1 | 4.71 | — | — | — | — | 1951 | — |
| 2 | 3.10 | 542 | 211 | 230 | 1863 | 1858 | 6175 |
| 3 | 2.84 | — | — | — | — | 1575 | — |
| 4 | 2.80 | — | — | — | — | 2342 | — |
| 5 | 2.51 | — | — | — | — | 2561 | — |
| 6 | 4.42 | — | — | — | — | 2157 | — |
| 7 | 3.05 | — | — | — | — | 2352 | — |
| 8 | 3.13 | — | — | — | — | 3351 | — |
| 9 | 2.98 | — | — | — | — | 2480 | — |
| 10 | 2.76 | — | — | — | — | 2850 | — |
| 11 | 2.91 | — | — | — | — | 2214 | — |
| 12 | 3.01 | — | — | — | — | 3431 | — |
| 13 | 2.70 | — | — | — | — | 3656 | — |
| 14 | 3.13 | — | — | — | — | 2025 | — |
| 20 | 16.76 | — | — | — | — | — | — |
| 21 | 12.87 | 2194 | 513 | 379 | 2638 | 1153 | 2634 |
| 22 | 10.24 | — | — | — | — | 675 | — |
| 23 | 9.02 | — | — | — | — | — | — |
| 24 | 6.87 | — | — | — | — | — | — |
| 25 | 20.35 | — | — | — | — | — | — |
| 26 | 10.71 | — | — | — | — | — | — |
| 27 | 15.59 | — | — | — | — | — | — |
| 28 | 15.45 | — | — | — | — | — | — |
| 29 | 2.21 | — | — | — | — | 1060 | — |
| 30 | 1.33 | — | — | — | — | 741 | — |
| 31 | 12.63 | — | — | — | — | 1259 | — |
| 32 | 5.12 | — | — | — | — | 1242 | — |

The test results will be evaluated first with respect to carburization resistance.

As will be apparent from Tables 1 and 2, the increases in the amount of C in the samples of the invention are all less than 5%, hence high resistance to carburization.

To investigate the relationship of the Si and Al contents to the increase in the amount of C in greater detail, FIG. 1 shows the results achieved by the samples (Nos. 1-3, 25, 26, 29 and 30) containing 0.78 to 0.88% of Al, and the Al-free samples (Nos. 20-24).

The samples containing 0.78 to 0.88% of Al will be discussed first. The increase in the amount of C is very small in the samples Nos. 1, 2, 3, 29 and 30 containing more than 2% of Si, this indicating that these samples are outstanding in carburization resistance. Although excellent in carburization resistance, the samples Nos. 29 and 30 seriously deteriorate as previously stated and are not suitable for use in reactor tubes. On the other hand, the samples Nos. 25 and 26 increased greatly in the amount of C. This shows that presence of up to 2% of Si is ineffective for improving the carburization resistance.

The results attained by the Al-free samples indicate that the carburization resistance improves with increasing Si content, but that the increases in the amount of C are great to show low carburization resistance.

It appears that when the alloy contains more than 2% of Si and a predetermined amount of Al, Si-Al double oxide is formed which gives remarkably improved carburization resistance. With reference to Tables 1 and 2, the samples No. 5 and No.13 which are approximately the same in Si content but are different in Al content are not greatly different in the increase in the amount of C. This indicates that insofar as the Si content is over 2%, differences in Al content give rise to no substantial problem with respect to carburization resistance.

Next, the creep rupture strength will be discussed.

First, the samples Nos. 2 and 21 were tested for creep rupture under varying conditions. The sample No. 2 is an example of the invention, while the sample No. 21 is a comparative example free from Al and having a reduced Si content. Table 2 shows the test results in terms of rupture time, indicating that in creep rupture strength, No. 2, example of the invention, is inferior to No. 21, comparactive example, under the condition of at least 1.3 kg/mm² in stress but is conversely superior thereto under the stress condition of up to 0.9 kg/mm².

Figure 2:
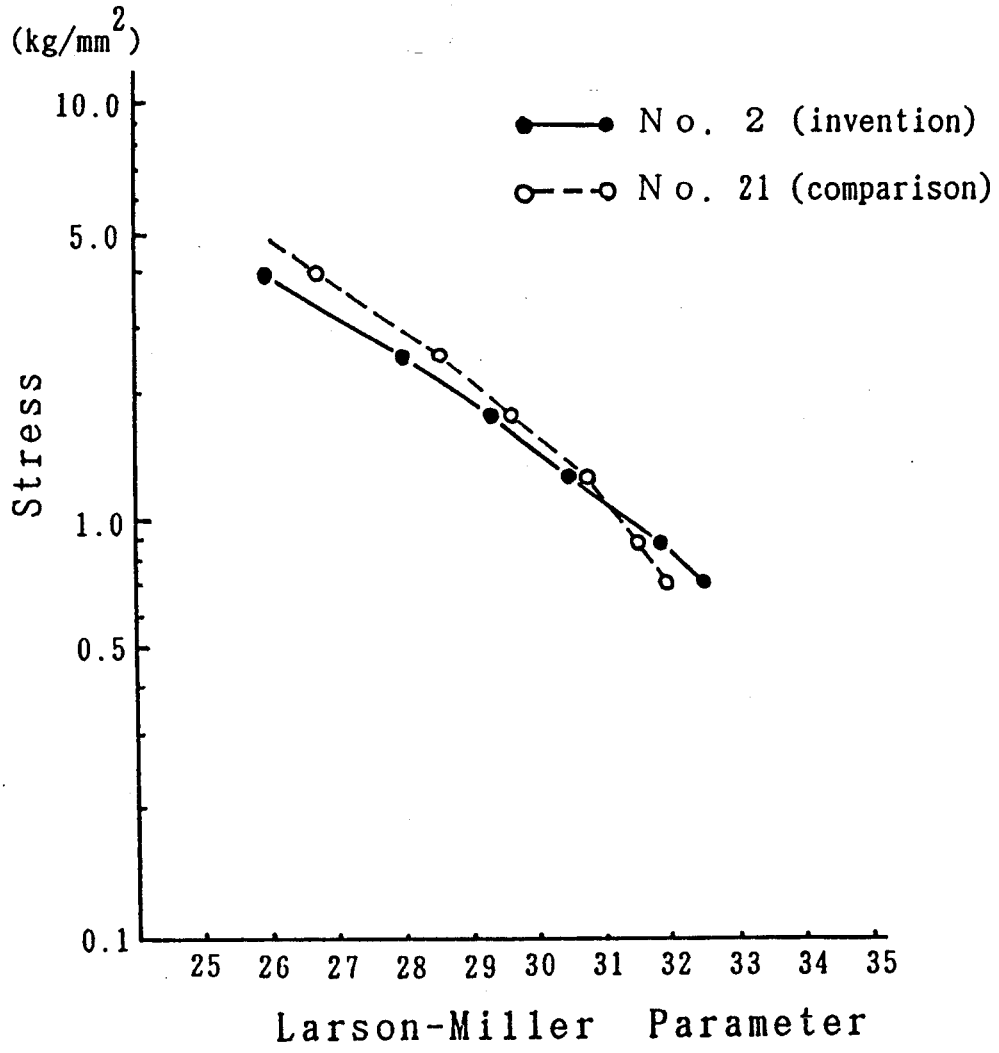
FIG. 2 is a graph wherein the Larson-Miller parameter is plotted which was determined from the results of a creep rupture strength test conducted under varying temperature and stress conditions.

In connection with the results of creep rupture test achieved by No. 2 and No. 21, the Larson-Miller parameter was calculated. FIG. 2 shows the calculated values. The Larson-Miller parameter theoretically defines the effect of time and temperature on creep and is expressed by:

$$P = T(C + \log t) \times 10^{-3}$$

wherein T is the test temperature in terms of absolute temperature (°K), t is rupture time (hrs) and C is a constant which is dependent on the material and for which a value of 20 was used as genrally used.

FIG. 2 reveals that the relation between the two samples in creep rupture strength characteristics represented by the parameter value becomes reverse at about 1.0 to about 1.2 kg/mm² in superiority, such that the sample No. 2, example of the invention, has superior creep rupture strength at lower stresses. Furthermore, the graph of FIG. 1 appears to indicate that the creep rupture strength, if excellent at a stress of 0.9 kg/mm², is also excellent under the condition in which the cracking tube is actually used Accordingly, under the condition of 1093° C., 0.9 kg/mm², the test pieces Nos. 1-14, No. 21, No. 22 and Nos. 29-32 were subjected to a creep rupture test, with the results shown in Table 2. Tables 1 and 2 indicate that all the examples of the invention are at least about 1500 hours in rupture time under the condition of 1093° C., 0.9 kg/mm² and are superior to the comparative examples. Thus, the alloys of the invention possess a high creep rupture strength under high-temperature low-stress conditions.

With reference to the comparative examples, the samples of No. 21 and No. 23, which are free from Al, are shorter in creep rupture time. Further No. 29 and No. 30, which contain a suitable amount of Al, are short in creep rupture time since they are not lower than 3% in Si content. No. 31 is relatively longer in creep rupture time because the sample contains additional elements such as Nb and W, but is still inferior to the examples of the invention because it is free from Al. Although containing a suitable amount of Si, No 82 has a low Al content and is therefore short in creep rupture time.

These results indicate that the alloys of the invention are excellent in carburization resistance, and have a high creep rupture strength under high-temperature low-stress conditions.

Accordingly, the alloys of the present invention are well-suited as materials for cracking tubes and reforming tubes in the petrochemical industry, i.e., as materials for hydrocarbon cracking or reforming reactor tubes.

What is claimed is:

1. A heat-resistant alloy having a high creep rupture strength under high-temperature low-stress conditions and an excellent resistance to carburization, said alloy consisting essentially of, in % by weight, from 0.44% inclusive to less than 1.5% of C, more than 2% to less than 3% of Si, more than 0% to less than 2% of Mn, more than 20% to less than 30% of Cr, more than 25% to less than 40% of Ni, more than 0.6% to less than 2% of Al, and the balance being Fe and inevitable impurities.

2. A heat-resistant alloy as in claim 1, wherein the amount of Al is from 0.7% inclusive to 1.8% inclusive.

3. A heat-resistant alloy having a high creep rupture strength under high-temperature low-stress conditions and an excellent resistance to carburization, said alloy consisting essentially of, in % by weight, from 0.44% inclusive to less than 1.5% of C, more than 2% to less than 3% of Si, more than 0% to less than 2% of Mn, more than 20% to less than 30% of Cr, more than 25% to less than 40% of Ni, more than 0.6% to less than 2% of Al, and at least one component selected from the group consisting of Zr, N, Nb, W and Ti in the following amounts:

from 0.01% inclusive to 0.5% inclusive of Zr,
up to 0.2% inclusive of N,
from 0.2% inclusive to 2.0% inclusive of Nb,
from 0.2% inclusive to 2.0% inclusive of W, and
from 0.01% inclusive to 0.3% inclusive of Ti, and balance being Fe and inevitable impurities.

4. A heat-resistant alloy as in claim 3, wherein the amount of Al is from 0.7% inclusive to 1.8% inclusive.

* * * * *